United States Patent [19]

Bolhuis

[11] Patent Number: 4,520,295

[45] Date of Patent: May 28, 1985

[54] STEP-WISE DIMMER CONTROL CIRCUIT FOR A DISCHARGE LAMP

[75] Inventor: Pieter J. Bolhuis, Eindhoven, Netherlands

[73] Assignee: U.S. Philips Corporation, New York, N.Y.

[21] Appl. No.: 436,538

[22] Filed: Oct. 25, 1982

[30] Foreign Application Priority Data

Nov. 9, 1981 [NL] Netherlands ..... 8105046

[51] Int. Cl.[3] ..... H05B 37/02; H05B 41/38

[52] U.S. Cl. ..... 315/291; 315/310; 315/128; 315/159; 315/DIG. 4

[58] Field of Search ..... 315/291, 310, DIG. 4, 315/360, 159, 128

[56] References Cited

U.S. PATENT DOCUMENTS 3,816,794 6/1974 Snyder ..... 315/310 X
4,144,478 3/1979 Nuver ..... 315/291
4,197,485 4/1980 Nuver ..... 315/DIG. 4 X
4,286,195 8/1981 Swinea, Jr. ..... 315/291 X
4,395,660 7/1983 Waskiewicz ..... 315/DIG. 4 X

*Primary Examiner*—David K. Moore
*Assistant Examiner*—Vincent DeLuca
*Attorney, Agent, or Firm*—Robert T. Mayer; Bernard Franzblau

[57] ABSTRACT

A dimming circuit for a discharge lamp (5) arranged in series with two electric coils (3, 4), one of which is by-passed by a semiconductor switching element (6).

The control circuit of the semiconductor switching element (6) includes a series arrangement of a resistor (15) and a capacitor (16) connecting a main electrode to the control electrode. The inductance of the by-passed coil (3) is chosen such that the semiconductor switching element (6) is made conductive on reignition of the lamp. The electric losses of the dimming arrangement are low.

10 Claims, 1 Drawing Figure

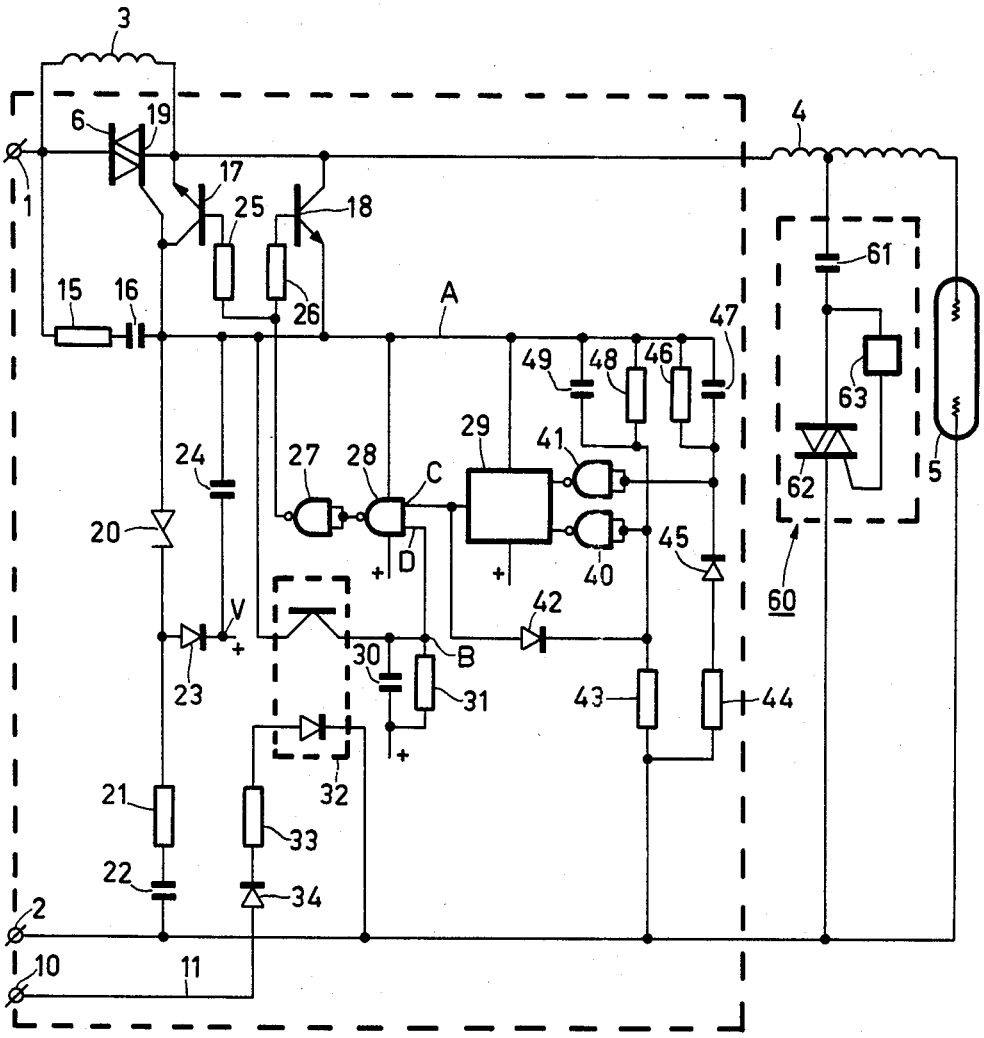
3
6
19
1
17
25
18
4
61
15
16
26
A
47
49
48
46
63
29
41
24
27
28
C
62
5
20
D
45
40
60
V
42
30
B
23
31
43
44
32
21
33
22
34
2
10
11

STEP-WISE DIMMER CONTROL CIRCUIT FOR A DISCHARGE LAMP

The invention relates to an electric arrangement for step-wise controlling the luminance of a gas and/or vapour discharge lamp. The arrangement may have two input terminals intended to be connected to an a.c. voltage source. In the operating condition of the lamp the input terminals are interconnected by a series arrangement of the lamp and at least two electric coils, one of the coils being bypassed by a first controlled semiconductor switching element having a thyristor characteristic. In the least dimmed state of the lamp a control circuit of that semiconductor switching element renders the semiconductor switching element conductive after a periodic zero-crossing the current through the lamp. An auxiliary arrangement is present to make it possible to block the operation of making the semiconductor switching element conductive, and the control circuit of the semiconductor switching element is formed by a connection from a control electrode to a main electrode of the semiconductor switching element.

A prior art electric arrangement of the type above-described is, for example, disclosed in U.K. Pat. No. 1,531,840. In the conductive state of the semiconductor switching element the lamp is in the non-dimmed state. In the non-conductive state of the semiconductor switching element the impedance arranged in series with the lamp is larger, causing the lamp to be dimmed. A dim command can be conveyed via the auxiliary arrangement. This prior art electric arrangement has the disadvantage that in series with the lamp there is still an additional coil across which the control circuit of the semiconductor switching element is connected. As this additional coil also carries the lamp current it must be dimensioned for that current. The last-mentioned coil complicates the main current circuit of the lamp and also causes additional electric losses in that circuit.

The invention has for an object to provide an electric arrangement of the type described in the opening paragraph wherein the main current circuit of the lamp is of a simple construction and exhibits few electric losses.

According to the invention, an electric arrangement for step-wise controlling the luminance of a gas and/or vapour discharge lamp comprises two input terminals intended to be connected to an a.c. voltage source. In the operating condition of the lamp the input terminals are interconnected by a series arrangement of the lamp and at least two electric coils with one of the coils being bypassed by a first controlled semiconductor switching element havig a thyristor characteristic. In the least dimmed state of the lamp a control circuit of the semiconductor switching element renders the semiconductor switching element conductive after a periodic zero-crossing of the current through the lamp. An auxiliary arrangement is present by means of which the operation of making the semiconductor element conductive can be blocked. The control circuit of the semiconductor switching element is in the form of a connection from a control electrode to a main electrode of the semiconductor switching element. The invention is characterized in that the connection from the control electrode to the main electrode of the semiconductor switching element is free of a voltage-increasing circuit element, and that the induction of the by-passed coil is so large that on reignition of the lamp after the said current zero-crossing the voltage at the control electrode of the semiconductor switching element is sufficient to make that switching element conductive.

This electric arrangement has the advantage that an additional electric coil is not required in the main current circuit of the lamp. Electrical losses in such a coil can therefore not occur.

The following should be noted by way of explanation. In the case where the lamps are dimmed, measures should be taken to ensure that the electrical losses owing to the dimming arrangement itself are only very small. Not until then is there a saving in the energy obtained by means of dimming so as to take full advantage therefore. The invention is based on the idea to combine a very simple control circuit of the semiconductor switching element with a simple way of activating this control circuit. Activation of the control circuit results in the semiconductor switching element becoming conductive. This activation is effected by utilizing the fast change in the electric current (i) through the lamp immediately after the current zero-crossing, that is to say when the lamp reignites at the beginning of a new half cycle. As the by-pass coil is arranged in series with the lamp, that same current change is also produced in the coil. If the inductance (L) of the by-passed coil is chosen of such a high value that the product $L \cdot di/dt$ (wherein t represents time) is so great that the control circuit of the first semiconductor switching element is activated, then the semiconductor switching element becomes conductive. By using this discontinuity in the current through the lamp, and consequently in the current through the by-pass coil, it is no longer necessary to use an additional coil in series with the lamp for activation of that control circuit. As mentioned already in the foregoing, the said prior art electric arrangement does comprise such an additional coil.

Since the first semiconductor switching element has a thyristor characteristic, this element remains conductive until its current decreases to below the hold current value, that is to say this element remains conductive after the short signal on its control electrode has disappeared.

The lamp is in the dimmed state when, by means of the auxiliary arrangement already mentioned in the foregoing, the semiconductor switching element is prevented from becoming conductive. If, in contrast therewith, the semiconductor switching element is periodically rendered conductive, then the lamp burns with undimmed brightness. The semiconductor switching element may, for example, be a thyristor. Alternatively, the semiconductor switching element may be in the form of two thyristors arranged in anti-parallel. The semiconductor switching element may alternatively be in the form of an element having a bidirectional thyristor characterist (Triac).

An electric arrangement in accordance with the invention may, for example, be used for road illumination. In that case a change to the dimmed state can be made in the night hours when there is little traffic using the road. An advantage of this system, compared with a circuit in which a number of light sources over the road is extinguished, is that the distribution of the illumination on the road surface remains constant. It is furthermore conceivable that an electric arrangement in accordance with the invention can be used to illuminate a tunnel, a higher or lower luminance in the tunnel being realized in dependence on the luminance outside the tunnel so as to obtain the least possible luminance contrast on driving into or out of the tunnel.

It is also possible to provide an electric arrangement in accordance with the invention with two or more dimming coils in the main circuit of the lamp, each of these dimming coils being by-passed by a respective semiconductor switching element. That arrangement has the advantage that several luminance stages can be realized.

In order to obtain the dimmed state the auxiliary arrangement might, for example, be of such a construction that it opens a switch in the connection from the control electrode to the main electrode of the first controlled semiconductor switching element.

In a preferred embodiment of an electric arrangement in accordance with the invention the control circuit of the first semiconductor switching element comprises a resistor, and the second controlled semiconductor switching element for two current directions being part of the auxiliary arrangement is provided between the control electrode and the other main electrode of the first semiconductor switching element. The dimmed state is then obtained by making this second switching element conductive.

An advantage of this preferred embodiment is that the reliability of the control circuit of the first semi-conductor switching element is not reduced by an additional switching element included therein. The resistor in the control circuit prevents, inter alia, the occurrence of an undesirably large current in the control circuit.

In an improvement of the last-mentioned preferred embodiment of an electric arrangement in accordance with the invention, the lamp being a high-pressure metal vapour discharge lamp, a control circuit of the second controlled semiconductor switching element comprises a timer circuit so that at least one minute must pass after the voltage has appeared between the input terminals of the electric arrangement before the second controlled semiconductor switching element is made conductive.

An advantage of this improvement is that starting of the lamp is always effected in the "undimmed circuit state". As a result thereof starting is effected in a more reliable manner. The saMe applies to renewed starting of the lamp after a short interruption in the AC supply voltage as after such an interruption—after the AC voltage is supplied again—the lamp often still has a high temperature so that as a rule its required reignition voltage is high. It is then advantageous for the electric arrangement to be in the undimmed circuit state.

A lamp operated by means of an electric arrangement in accordance with the invention may, for example, be a low-pressure mecury vapour discharge lamp. If this lamp has preheatable electrodes a timer circuit, as mentioned above, can be used to advantage. Namely, in that case sufficient voltage can be made available to preheat the electrodes so as to promote ignition of the lamp. It is then often possible to use an undimmed circuit state of less than one minute.

In a further improvement of said preferred embodiment of an electric arrangement in accordance with the invention the control circuit of the second controlled semiconductor switching element comprises an opto-coupler with a light source of that opto-coupler being connected to a control conductor. Switching the light source off result to a different conductivity state of the second semiconductor switching element.

An advantage of this improvement is that a dim command, entering via the control conductor, is conveyed in an electrically safe manner to the control circuit of the second controlled semiconductor switching element.

An embodiment of the invention will now be described by way of example with reference to the accompanying drawing.

This drawing shows an electric arrangement in accordance with the invention.

The reference numerals 1 and 2 denote input terminals intended to be connected to an a.c. voltage supply of approximately 220 Volts, 50 Hertz. The terminals 1 and 2 are interconnected via a series arrangement of a first coil 3, a second coil 4 and a high-pressure sodium vapour discharge lamp 5. A high-pressure sodium vapour discharge lamp is, for example, described in Netherlands Patent Specification No. 154.865 (PHN 2385). The coil 3 is by-passed by a first controlled semiconductor switching element 6 which has a bi-directonal thyristor characteristic (Triac). The connection from terminal 1 through the circuit elements 3, 6 via 4 and 5 to the terminal 2 represents the main current circuit. Reference numeral 10 denotes a terminal of a control conductor 11.

Via a series arrangement of a resistor 15 and a capacitor 16, the terminal 1 is connected to the control electrode of the semiconductor switching element 6. This control electrode of the switching element 6 is also connected to a main electrode 19 of the switching element 6 via two transistors 17 and 18 connected in anti-parallel. This main electrode is present at that side of the switching element which faces the coil 4. The transistors 17 and 18 together form the second controlled semiconductor switching element.

The control electrode of the semiconductor switching element 6 is further connected to the input terminal 2 via a Zener-diode 20 in series with a resistor 21 and a capacitor 22. The Zener-diode 20 is by-passed by a series arrangement of a diode 23 and a capacitor 24.

The base of the transistor 17 is connected to a resistor 25. The base of the transistor 18 is connected to a resistor 26. The other sides of these resistors 25 and 26 are interconnected and are also connected to the output terminal of a NAND-gate 27. The gate 27 is connected to the output terminal of a NAND-gate 28. As regards its power supply, this gate is connected at one end to a junction V between the diode 23 and the capacitor 24 and at its other end to a conductor A, which is connected to the control electrode of the switching element 6. A gate 27, a further gate 40 and 41 still to be described hereinafter, are also connected to the power supply V-A (these connections are not shown). A first input terminal C of the gate 28 is connected to an integrated circuit (i.c.) 29. This i.c. is of the Philips type HEF 4020. Another input terminal D of the gate 28 is connected to a point B. Via a parallel arrangement of a capacitor 30 and a resistor 31 the point B is connected to junction V between the diode 23 and the capacitor 24. Via a light-sensitive portion of an opto-coupler 32 the point B is also connected to the conductor A. The light-emitting portion of this opto-coupler 32 is connected at one end to the input terminal 2 and at its other end to a resistor 33. The other side of this resistor 33 is connected to a rectifier 34, which in turn is connected to the control conductor 11. The i.c. 29 is energized by a circuit one side of which is connected to the junction V between the diode 23 and the capacitor 24 and the other side to the conductor A. An input terminal of the i.c. 29 is connected to an output terminal of a NAND-gate 40. A further input terminal of the i.c. 29 is connected to a NAND-gate 41. A junction between the i.c. 29 and the gate 28 is connected to an input terminal of the gate 40 via a diode 42. This input terminal is also connected to the terminal 2 via a resistor 43. A resistor 44 is connected in series with a diode 45 to the terminal 2. The other side of this diode 45 is connected to an input terminal of the gate 41. The diode 45 is also connected to a parallel arrangement of a resistor 46 and a capacitor 47. The other side of this parallel arrangement is connected to the conductor A. The input terminal of the gate 40 is also connected to the conductor A via a parallel arrangement of a resistor 48 and a capacitor 49. Reference numeral 60 shows, partly schematically, an electronic starter for the initial ignition of the lamp 5. One side of this starter is connected to a tap on the coil 4 and the other side is connected to terminal 2.

The starter 60 comprises a series arrangement of a capacitor 61 and a controlled bidirectional semiconductor switching element 62 (Triac). A control arrangement 63 (shown schematically) is connected to a junction between the capacitor 61 and the switching element 62, and also to a control electrode of the switching element 62.

The circuit described operates as follows. Let it be assumed that initially an electric signal is present on the control conductor 11 as a result of which the light-emitting portion of the opto-coupler 32 irradiates the light-sensitive portion. This results in the undimmed state of the lamp 5. This can be explained as follows. When the terminals 1 and 2 are connected to the 220 Volts, 50 Hertz a.c. voltage, the second semiconductor switching element (17, 18) will be in the non-conducting state and will remain there. This caused by the fact that the i.c. 29 first counts the power supply ac cycles which are applied to the relevant input of the i.c. 29 via the gate 40. Not until this counting operation has finished, in the present case after 163 sec., will the output of i.c. 29 change from a low potential to a high potential. In response thereto the voltage at the input of gate 40 becomes high via the rectifier 42. As a result thereof gate 40 cannot convey square-wave voltages, so that the voltage at the input C of the gate 28 remains high. As in the present case the voltage at the input D of the gate 28 is low, the input of the gate 27 becomes high and the output of the gate 27 becomes low. This prevents the transistors 17, 18 from becoming conductive.

Now the control circuit 15, 16 of the switching element 16 ensures that this switching element becomes conductive, causing coil 3 to be short-circuited. As a result thereof the lamp 5 can start in the "undimmed circuit state".

It should be noted that making the switching element 6 conductive, during the starting of the lamp, is effected by a high voltage across the coil 3 in response to a series resonance with the capacitor 61 produced when the switching element 62 of the starter 60 becomes conductive.

The current pulses then occurring in a portion of the coil 4 induce a high voltage in the other portion of that coil, resulting in a voltage which ignites the lamp 5.

When the lamp 5 is ignited, the starter 60 is made inoperative via its voltage-dependent control arrangement 63.

The switching element 6 is then again made conductive by its control circuit 15, 16 some microseconds after each zero-crossing of the current through the lamp 5. The reason is that the inductance of the coil 3 is so larger that the voltage across the coil—on reignition of the lamp after such a zero-crossing—is sufficient to adjust the switching element 6 to the conducting state. The switching element 6 continues to conduct until the current therethrough—at the end of half a cycle—decreases to below the hold current value.

Now the situation will be considered in which there is no voltage on the current conductor 11. The point B, which is connected to the input D of the gate 28, has then a high potential. If, after the previously mentioned 163 seconds have elapsed, the terminal C has also reached the high potential, the input terminal of the gate 27 becomes low and the output of this gate 27 becomes high. This results in the transistors 17 and 18 becoming conductive. As a result thereof the switching element 6 can no longer remain in the conducting state.

Then the dimmed state has been obtained, namely the state in which the lamp 5 burns in series with two coils, namely 3 and 4.

The capacitor 47 functions so that after a short AC supply voltage interruption the lamp also ignites in the "undimmed circuit state", and independently of any signal on the control conductor 11.

The assembly of the circuit elements 20 to 24 inclusive serves to produce an auxiliary d.c. voltage, the point V of which has the positive potential. This auxiliary d.c. voltage serves to supply the gates and the i.c., as indicated in the circuit description.

In the described case the circuit elements had approximately the following values:

Resistor 15: 470 Ohm
Resistor 21: 4.7K Ohm
Resistor 25: 4.7K Ohm
Resistor 26: 4.7K Ohm
Resistor 31: 1M Ohm
Resistor 33: 22k Ohm
Resistor 43: 1M Ohm
Resistor 44: 8.2M Ohm
Resistor 46: 1M Ohm
Resistor 48: 1M Ohm
Capacitor 16: 0.1 μFarad
Capacitor 22: 0.1 μFarad
Capacitor 24: 68 μFarad
Capacitor 30: 22 nanoFarad
Capacitor 47: 22 nanoFarad
Capacitor 49: 4.7 nanoFarad
Capacitor 61: 0.6 μFarad
Coil 4: 2.19 Henry
Coil 3: 2.04 Henry At this inductance of the coil 3 the peak voltage across that coil, on reignition of the lamp 5 (undimmed circuit state) was approximately 20 Volts. This was sufficient to render the switching element 6 conductive.

It is conceivable tht more than one by-passed dimming coil arrangement (3, 6) be connected in series with the lamp for example, two by-passed dimming coils being present. In that case, by selective switching, for example also by means of a control conductor and opto-couplers, more than one dimming position can be realized.

The described circuit provides a simple way to dim the high-pressure sodium lamp 5, of approximately 250 Watt in the undimmed state. The losses in the dimming arrangement are approximately 5 Watt.

I claim:

1. An electric arrangement for step-wise controlling the luminance of a discharge lamp comprising, two input terminals adapted to be connected to an a.c. voltage source, means connecting a series arrangement of the lamp and at least two electric coils across said input terminals, a first controlled semiconductor switching element having a thyristor characteristic connected in parallel with one of said coils, a control circuit coupled to the semiconductor switching element so as to make the semiconductor switching element conductive after a periodic zero-crossing of the current through the lamp in the least dimmed state of the lamp, and an auxiliary arrangement coupled to the control circuit so as to inhibit the operation thereof by means of which the semiconductor switching element is made conductive, the control circuit of the semiconductor switching element comprising a connection from a control electrode to a main electrode of the semiconductor switching element that is free of a voltage-increasing circuit element, the inductance of said one coil having a value such that on reignition of the lamp after said zero crossing of the current, the one coil produces a voltage on the control electrode of the semiconductor switching element sufficient to make said switching element conductive.

2. An electric arrangement as claimed in claim 1, wherein the control circuit of the first semiconductor switching element comprises a resistor, and the auxiliary arrangement includes a second controlled bidirectional semiconductor switching element coupled between the control electrode and the other main electrode of the first semiconductor switching element.

3. An electric arrangement as claimed in claim 2, wherein the lamp comprises a high-pressure metal vapour discharge lamp and the arrangement further comprises a control circuit for the second controlled semiconductor switching element including a timer circuit that delays conduction of the second semiconductor switching element for at least one minute after a voltage has appeared between the input terminals of the electric arrangement

4. An electric arrangement as claimed in claim 3, wherein the control circuit of the second controlled semiconductor switching element incorporates an optocoupler that includes, a light source connected to a control conductor, switching off the light source resulting in a different conductivity state of the second semiconductor switching element.

5. Apparatus providing stepped intensity control of the luminance of an electric discharge lamp comprising: a pair of input terminals for connection to a source of AC voltage, a pair of output terminals for connection to a discharge lamp, first and second inductors, means connecting said first and second inductors and said output terminals in a series circuit across said input terminals, a first semiconductor controlled switching element having a thyristor characteristic connected in parallel with the first inductor, a control circuit including a capacitor and connected between a control electrode and one main electrode of the semiconductor switching element, the inductance of the first inductor having a value sufficient to produce a voltage at the control electrode of the semiconductor switching element to make said switching element conductive upon reignition of the lamp after a periodic zero-crossing of the lamp current, and an auxiliary arrangement coupled to the control electrode of the semiconductor switching element so as to selectively inhibit conduction of the switching element thereby to step-wise reduce the luminance of the lamp.

6. Apparatus as claimed in claim 5 wherein said auxiliary arrangement includes means for delaying operation thereof prior to initial ignition of the lamp whereby the lamp is started in the undimmed state.

7. Apparatus as claimed in claim 5 wherein the auxiliary arrangement includes controlled bidirectional semiconductor switching means coupled between the control electrode and the other main electrode of the first semiconductor switching element.

8. Apparatus as claimed in claim 5 wherein the control circuit includes a resistor serially connected with said capacitor between said control electrode and said one main electrode of the first semiconductor switching element, said control circuit being free of any inductor elements.

9. Apparatus as claimed in claim 5 further comprising an electronic starter circuit coupled across said output terminals, said electronic stater including a second capacitor that forms a series resonant circuit with said first inductor to produce a high voltage across the first inductor during starting of a lamp.

10. Apparatus as claimed in claim 9 wherein the electronic starter circuit is connected between one of said output terminals and a tap point on the second inductor.

* * * * *